US005483769A

United States Patent [19]

Zweili

[11] Patent Number: 5,483,769

[45] Date of Patent: Jan. 16, 1996

[54] DOOR DRIVE EQUIPMENT FOR MASS TRANSIT VEHICLE

[75] Inventor: Marc Zweili, Roxboro, Canada

[73] Assignee: Mark IV Transportation Products Corporation, Niles, Ill.

[21] Appl. No.: 164,120

[22] Filed: Dec. 7, 1993

[51] Int. Cl.[6] ..... E05C 7/06

[52] U.S. Cl. ..... 49/118; 49/218

[58] Field of Search ..... 49/209, 210, 218, 49/225, 118, 122, 362

[56] References Cited

U.S. PATENT DOCUMENTS

| | | | |
|---|---|---|---|
| 2,937,867 | 5/1960 | Schweig | 49/118 |
| 4,000,582 | 1/1977 | Monot | 49/218 |
| 4,457,108 | 7/1984 | Kuschel et al. | 49/225 X |
| 4,924,625 | 5/1990 | Dilcher | 49/212 |
| 5,140,770 | 8/1992 | Morvan | 49/215 |
| 5,142,823 | 9/1992 | Goldbach | 49/118 |
| 5,263,280 | 11/1993 | Dilcher | 49/212 |
| 5,271,181 | 12/1993 | Pietro | 49/118 |

FOREIGN PATENT DOCUMENTS

| | | | |
|---|---|---|---|
| 0492743-A1 | 7/1992 | European Pat. Off. . | |
| 2216898 | 11/1972 | Germany | 49/225 |

*Primary Examiner*—Brian K. Green
*Assistant Examiner*—Jerry Redman
*Attorney, Agent, or Firm*—Francis J. Lidd

[57] ABSTRACT

A power door operator for vehicles requiring uninterrupted car surfaces in a door area and minimal use of car interior space, particularly in the closed position. The equipment provided utilizes a rotary motor drive and distributed gear system for moving opposing door panels away from an opening in the car wall. Movement of the doors into and out of the car door opening is accomplished through use of controlled reaction travel of the rotary drive motor.

9 Claims, 7 Drawing Sheets

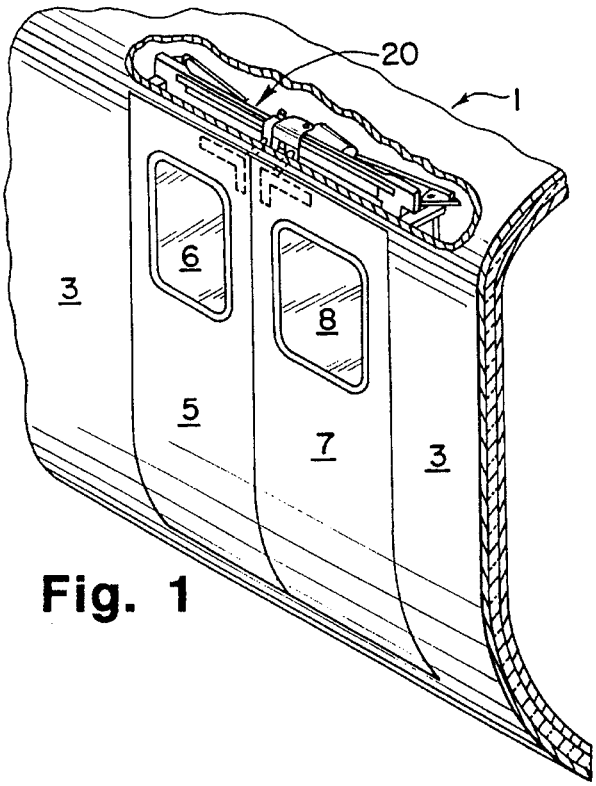
Fig. 1
Fig. 2
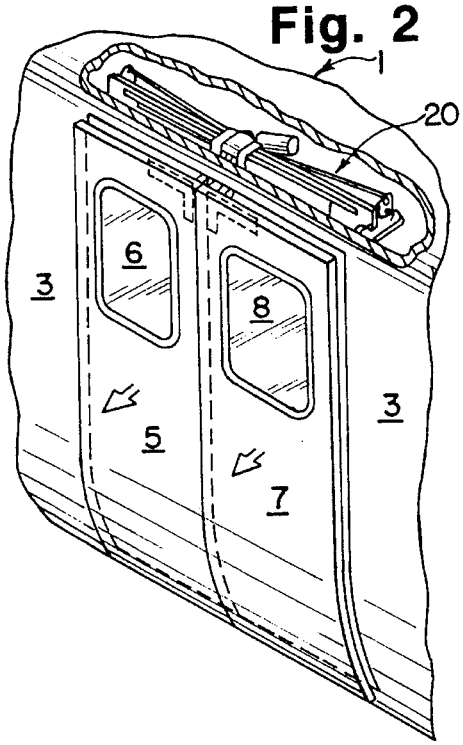
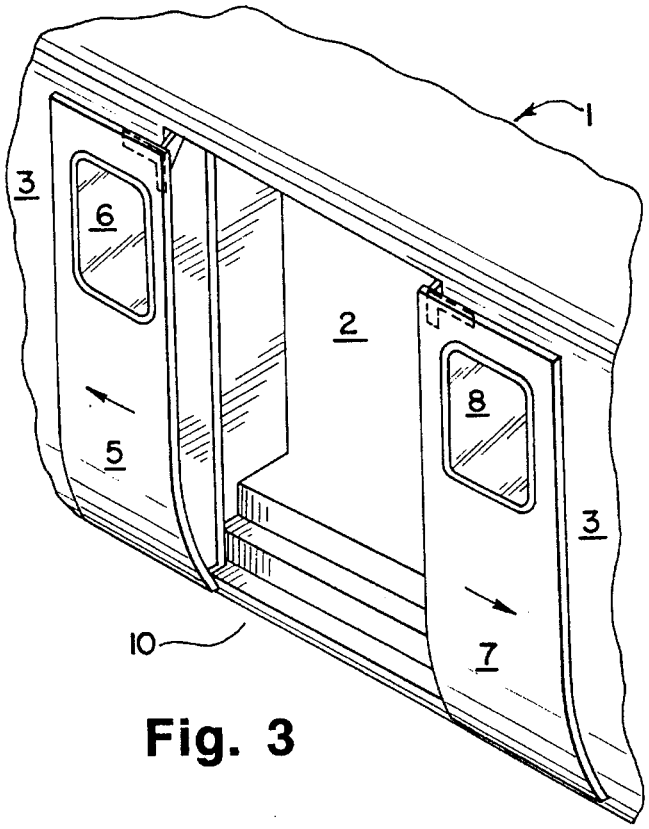
Fig. 3

DOOR DRIVE EQUIPMENT FOR MASS TRANSIT VEHICLE

BACKGROUND OF THE INVENTION

This invention relates generally to power door drive equipment for mass transit vehicles, and more particularly to door operators for use in vehicles requiring essentially uninterrupted side wall surfaces when the vehicular doors are closed. Operators of this type are commonly used to operate "plug" doors in that in a closed position, the doors occupy space essentially equal to that of the car wall were it not interrupted by a door opening. In a door open position, doors of this type move away from the opening outside of the vehicle after being "unplugged."

Known operators providing plugging and unplugging operation along with outside location of open door leaves are typified by U.S. Pat. No. 5,142,823. While these units appear satisfactory, the structures utilized incorporate certain shortcomings, particularly in properly handling the large cantilever load having a substantial inertial component imposed on the operator structure by the doors typically used. Also, if tracked guides into and out of the car wall opening are used, inertial wear on track members reduces door reliability. When rotary prime movers are required, conversion to rectilinear motion involves complicated mechanisms, including rotating screw and nut components. Also, the above-mentioned system utilizes mechanical belts or cables which, in many cases, also cannot be used.

In particular, the invention disclosed herein utilizes a rotary prime mover, mechanical drives excluding cables and belts. Further, the plugging and unplugging operation disclosed involves relatively simple mechanical linkages of the type having high reliability and requiring low maintenance.

Therefore, it is an object of this invention to provide a highly reliable outside sliding plug door system driven by a rotary electrical or fluid powered motor.

It is a further object of this invention to provide an outside sliding plug door drive in which the plugging and unplugging operation is actuated by simple and inexpensive mechanical linkages.

It is a further object of this invention to provide an outside sliding plug door drive wherein the plug/unplug operation, and sliding door movement outside the car body is provided by a single rotary actuator.

It is an additional object of this invention to provide an outside sliding plug door operator wherein in a door closed position the individual door panel hangers are maintained within the confines of the opening in the car side wall.

It is a further object of this invention to provide an outside sliding plug door operator wherein door weight loads and door drive loads are applied to separate components.

It is an additional object of the invention to provide an outside sliding plug door operator wherein door sliding and plugging movements are accomplished by separate mechanical components activated sequentially through response to drive motor torque.

SUMMARY OF THE INVENTION

The invention disclosed herein is a power door drive for moving hi-parting door panels out of and away from a passenger door opening in a transit car side wall. In the open position, door panels are suspended closely adjacent to the car side wall. In a closed position, the door panels present a relatively uninterrupted car body surface, since each panel is shaped in accordance with car body contours.

In order to achieve the relatively uninterrupted surface, a pair of bi-parting doors are suspended from a base plate mounted overhead in the car body opening.

Door motion is achieved through the use of a centrally located rotary motor having a housing mounted on the overhead base plate. Door movement over and away from the car body opening is achieved through a pinion gear on the motor output shaft and individual gear racks attached to each door panel. On rotation of the pinion gear, since opposing panels of the bi-parting pair are attached to upper and lower racks, rotation of the motor shaft pinion produces opposite or bi-parting motion of the door panels.

Movement of the door panels in a closed position into and out of the car side wall termed "plugging" is achieved through the use of pivots intermediate each end of the door base plate and the car side wall. Plugging or shifting the operator base plate into and out of the door opening is achieved by torque controlled mounting of the rotary motor housing on the operator base plate.

In operation, with the doors unplugged or out of the car body opening, unidirectional rotation of the pinion gear provides reciprocal movement of the door panels such that they are moved either together over the opening or away to uncover the opening. In keeping with the invention disclosed, when the pinion and rack drive system moves the doors into a closed position with adjacent edges of the door panels in abutment over the car body opening. In this position there is an increase in the drive motor shaft torque required to simply move the doors into the closed position. This increased torque on the motor shaft, acting on the aforementioned novel drive motor mounting, essentially counter-rotates the motor housing through a limited and predetermined mount.

Affixed to the housing is a sector gear section cooperating with an additional base mounted pinion and a rotating lever affixed to the pinion. The motor housing reverse motion is thereby transmitted to the pinion gear lever. Also attached to the reverse movement pinion gear lever are base shifting rods or links attached to the above described base plate pivots. The geometry of this linkage is such that reverse or reaction motor housing movement is transmitted to the base plate pivots, thereby moving or shifting the door operator base plate into and out of the car body door opening.

Limit switches (not shown) are utilized in the conventional manner to detect door movement into the car body wall and interrupt power to the drive motor. Similarly, limit switches are used in a conventional manner to detect bi-parting panel movement away from the door opening after unplugging, thereby interrupting power to the drive motor with the doors in fully open or closed and plugged position.

Other objects and advantages of the invention will become apparent from the drawings and the specification.

BRIEF DESCRIPTION OF THE DRAWINGS

FIGS. 1, 2, and 3 are perspective views of a portion of the car body side wall and door operator of the invention, particularly showing the bi-parting door panels, respectively, in a fully closed and plugged position, a closed and unplugged position, and a fully open position.

DETAILED DESCRIPTION OF THE INVENTION

Figure 4:
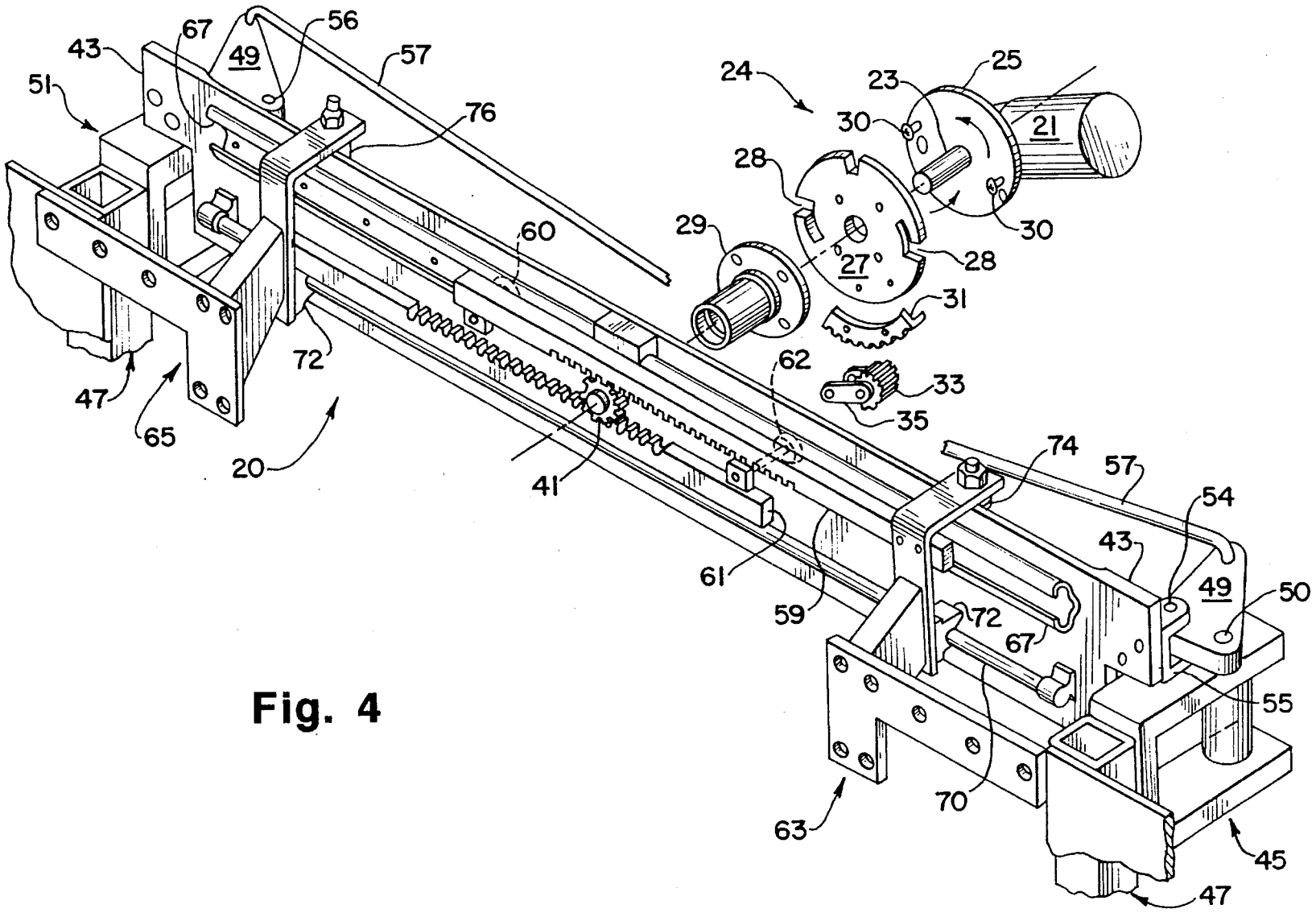
FIG. 4 is a perspective view of the operating portion of the invention incorporating an exploded view of the limited motion door drive assembly, location of the door drive rack and pinion assembly, and door support brackets mounted on the door base plate.

With particular reference to FIGS. 1 to 3, there is shown a partial transit vehicle exterior 1 having a side wall 3 and oppositely sliding doors 5 and 7 mounted for a flush or plugged closed position, and unplugged or motion to the exterior of car wall 3 in the opened position (reference FIG. 3).

Plugging and unplugging of doors 5 and 7 and sliding movement away from the opening 2 in car side wall 3 is achieved by use of an overhead operator assembly 20. As shown, doors 5 and 7 are of a contoured flush fitting design having windows 6 and 8 therein.

With particular reference to FIGS. 4, 5, 7 and 8, the overhead operator assembly 20 utilizes a rotary drive motor 21 of either electric, hydraulic, or pneumatic type having an output shaft 23. The motor housing is movably mounted to the operator base plate 43 using a shaft reaction drive assembly 24. As the drive assembly 24 is an important portion of the invention disclosed, its operation will be described in more detail below.

A door drive pinion gear 41 is fixed to output shaft 23 and positioned so as to operatively engage upper and lower door drive gear racks 59 and 61.

Doors 7 and 5 are movably attached to the door operator base plate 43 through door carrying bracket assemblies 63 and 65, respectively.

The slide plug overhead door operator assembly 20 base plate 43 is mounted at each edge of the side wall opening 2 to car side wall structural members 47. To properly support assembly 20, massive base plate mounting brackets 45 and 51 are attached to members 47. Intermediate the upper edge of brackets 45 and 51 and the base plate 43 are pivotal linkages 53, 55 and base plate plugging levers 49. Plugging members 49 operatively pivot around pivots 50 in brackets 45 and 51. An additional pivotal motion between plugging brackets 49 in the base plate 43 is achieved through ends 54 and 56, respectively.

Doors 7 and 5 are operatively attached to the gear racks 59 and 61, respectively, by door carrying bracket assemblies 63 and 65, respectively. Bracket assemblies 63 and 65 are movably attached to the base plate 43 by slidable guides 72 cooperating with door support 70 (reference FIG. 4). Rollers 74 and 76 are operatively attached to assemblies 63 and 65, respectively, for load carrying along the back side of base plate 43. A part of the door support and guide system also attached to base plate 43 is roller guide 67. Roller guide 67 contains rollers 60 and 62 attached to opposite ends of gear racks 59 and 61.

Figure 8:
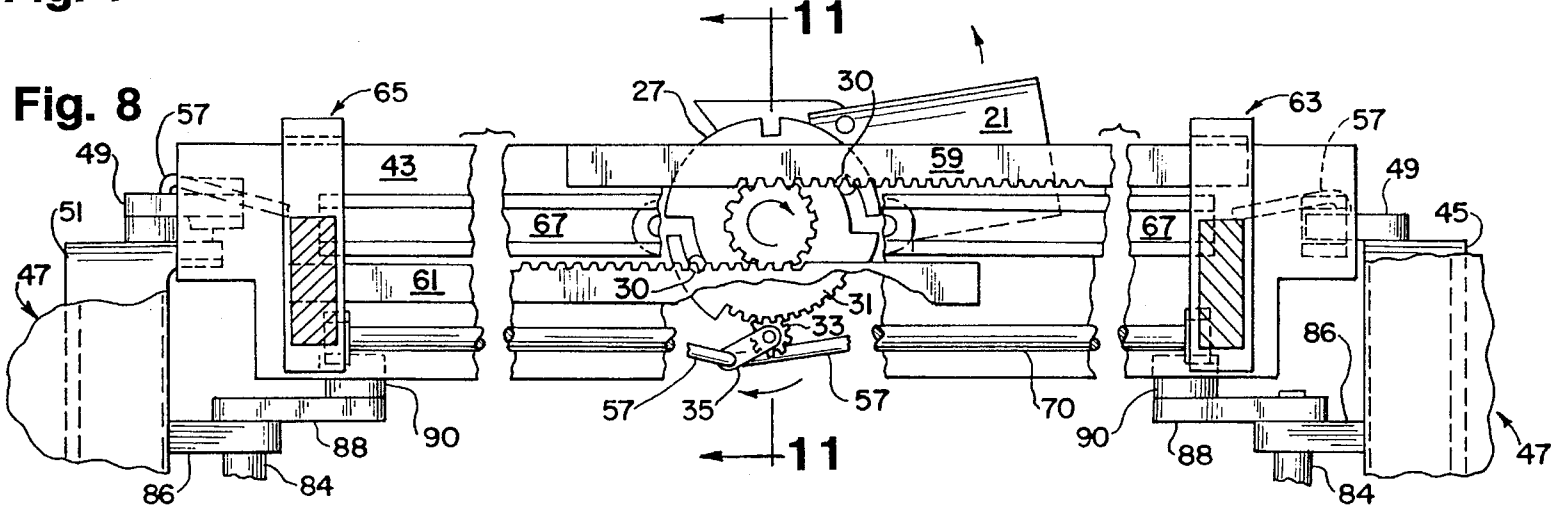
FIG. 8 is a front view of the door drive assembly portion of FIG. 7, particularly showing the motor housing setter gear and its associated pinion and door actuating links with direction arrows corresponding to the door pivot motion of FIG. 7.

The door motor reaction drive assembly 24 cooperates with door plugging rods 57 pivotally attached to plugging levers 49 and a pinion rod lever 35 attached to reaction pinion 33 (reference FIG. 8).

Figure 5:
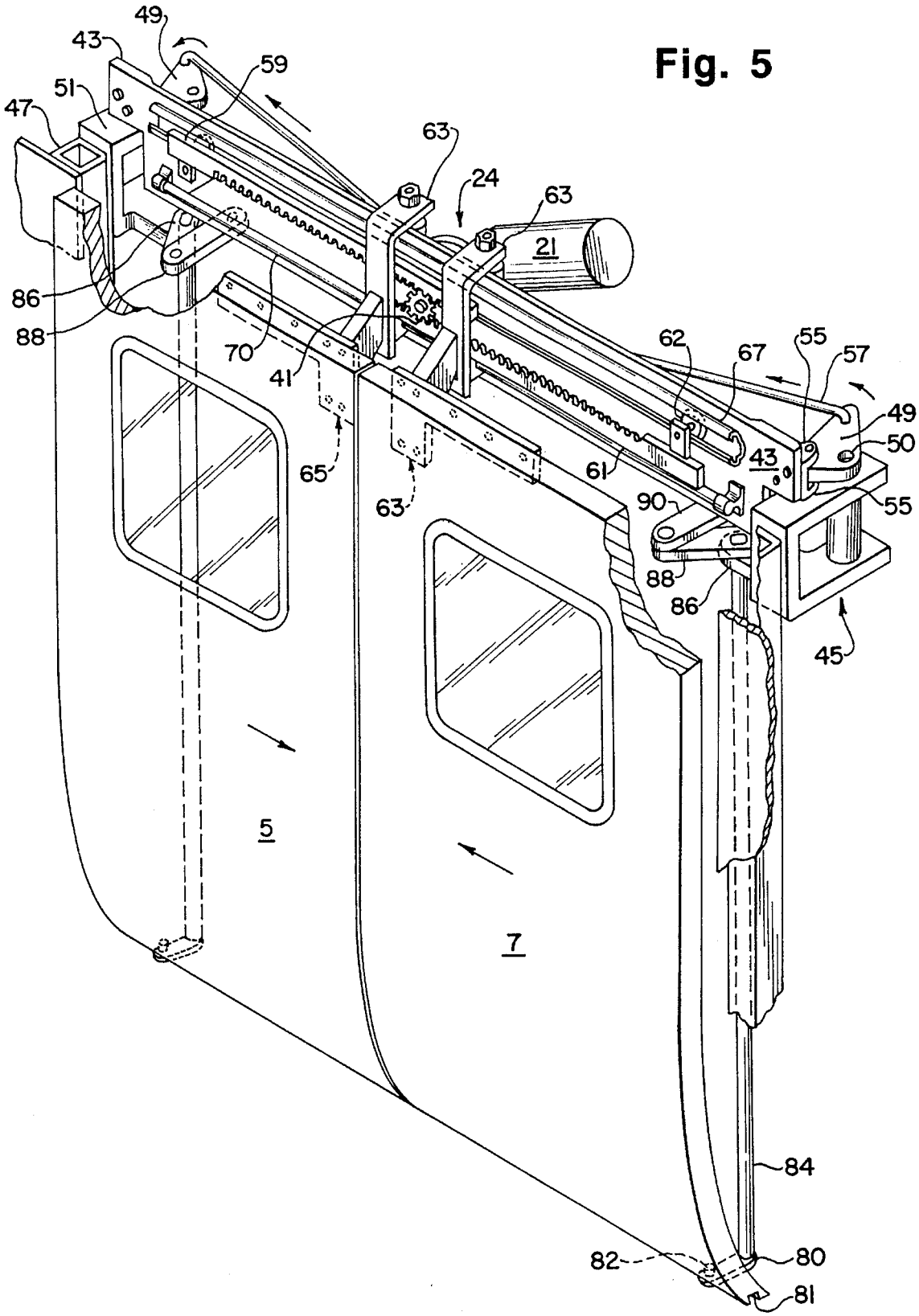
FIG. 5 is a perspective view with partial tear-always of the entire door operator in position overhead of a pair of hi-parting doors in a closed, unplugged position, particularly showing door mounting on the operator base plate and base plate shifting pivots.

With particular reference to FIG. 5, also attached to the base plate 43 is lower door support shaft drive link 90. Link 90 and lower door support drive link 88 are pivotally connected, with the opposite end of link 88 drivingly attached to lower door support shaft 84. The upper portion of shaft 84 is journaled in a bracket 86 attached to car structure 47. The lower end of shaft 84 is fixed to lower door support 80 for limited rotation therearound. The door support pin 82 extends upward from the opposite end of link 80, engaging a slot or guide 81 in the lower edge of door 7.

Operation of drive assembly 24 is as follows:

Torque from drive motor 21 is transmitted through shaft 23 and ultimately turns pinion 41. The motor housing of drive motor 21 is attached to the primary friction plate 25. Plate 25 and secondary friction plate 27 form a limited motion torque controlled coupling between the primary plate 25 and the secondary plate 27. Motion is limited to the peripheral length of slots 28 in the secondary friction plate 27 by pins 30. Plate 27 is rigidly attached to reaction drive flanged journal 29 and further fixedly attached to the base plate 43 allowing shaft 23 to be journaled and attached to pinion 41.

Figure 10:
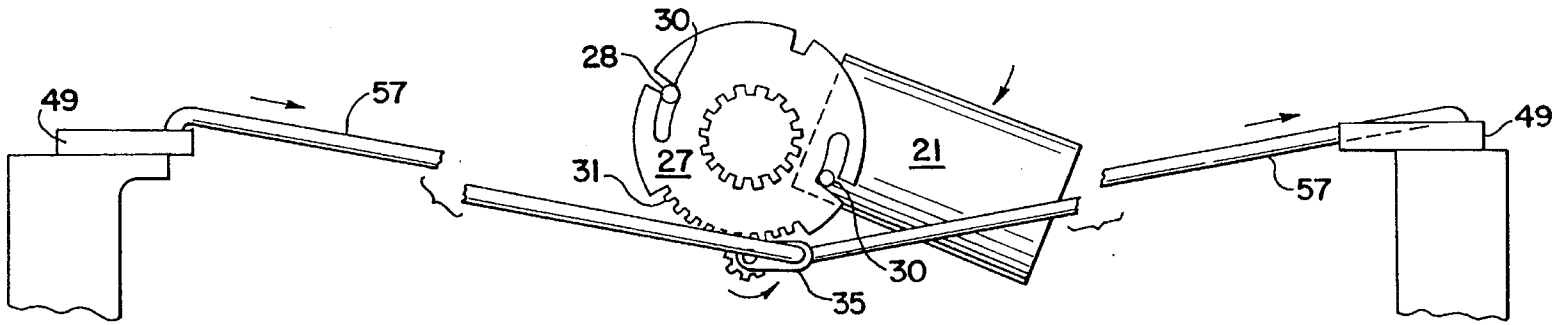
FIG. 10 is a partial front view of the operator shown in FIG. 9, particularly showing a base shifting linkage arrangement as driven by the motor housing sector gear, with direction arrows for moving the operator base from a fully closed and unplugged to a plugged position.
Figure 11:
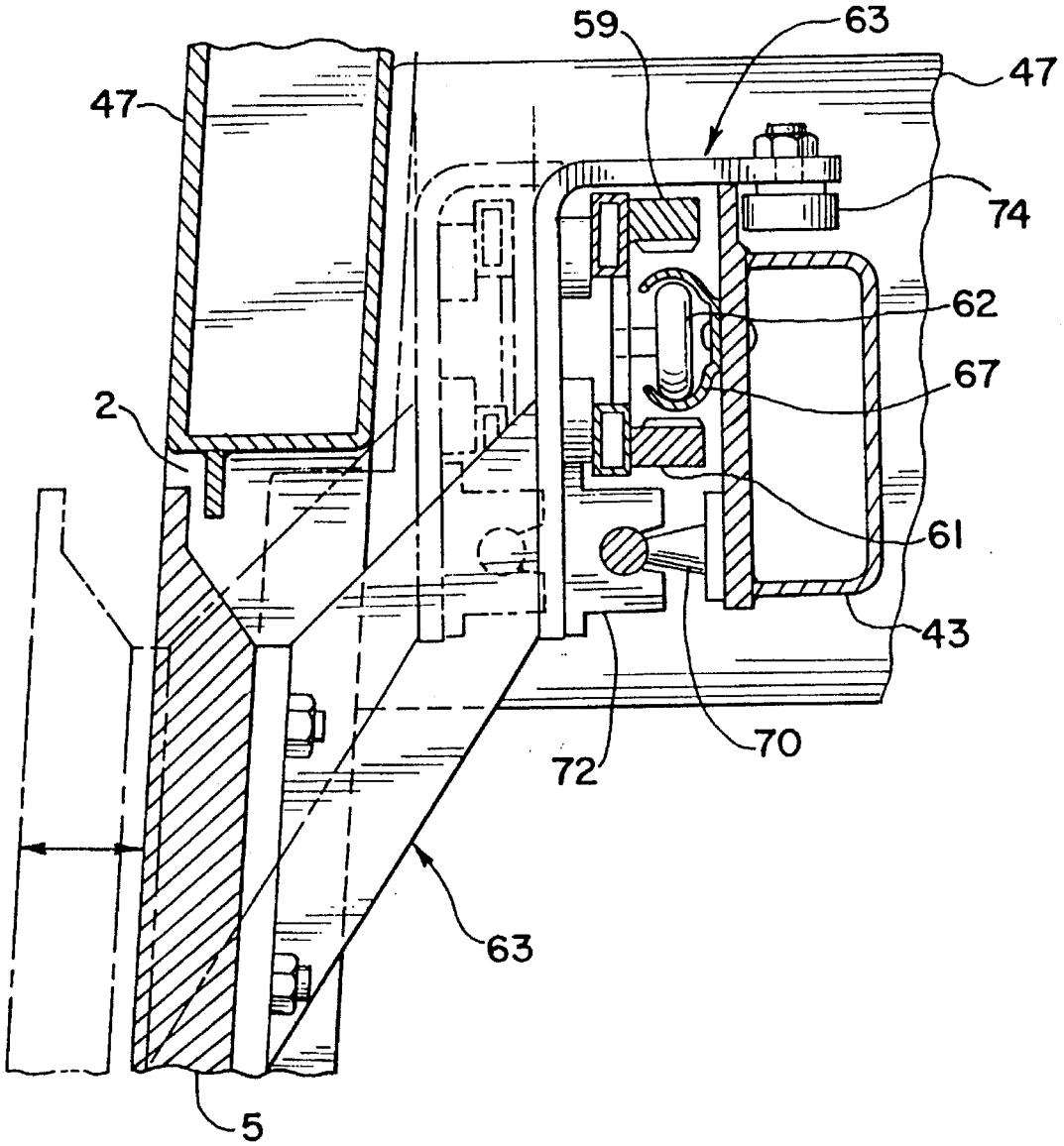
FIG. 11 is a partial section of the operator base plate along the line 11—11 of FIG. 8, particularly showing a door in the plugged position and location of door drive brackets as attached to the operator base plate. Door and base plate locations for an unplugged position are shown in a phantom view.

With reference to FIGS. 8 and 10, also attached to the primary reaction drive friction plate 25 is sector gear 31. Also attached to the lower edge of base plate 43 is a reaction pinion 33 consisting of a pivoting lever 35 and reaction pinion 33 rotatably attached to base plate 43 at one end of lever 35. Lever 35 is fixed to and rotates with pinion 33, and at its opposite end, is rotatably attached to rods 57. As sector gear 31 and reaction pinion 33 are in operative engagement, rotation of motor plate 25, turns lever 35 thereby rotating plugging levers 49.

Figure 6:
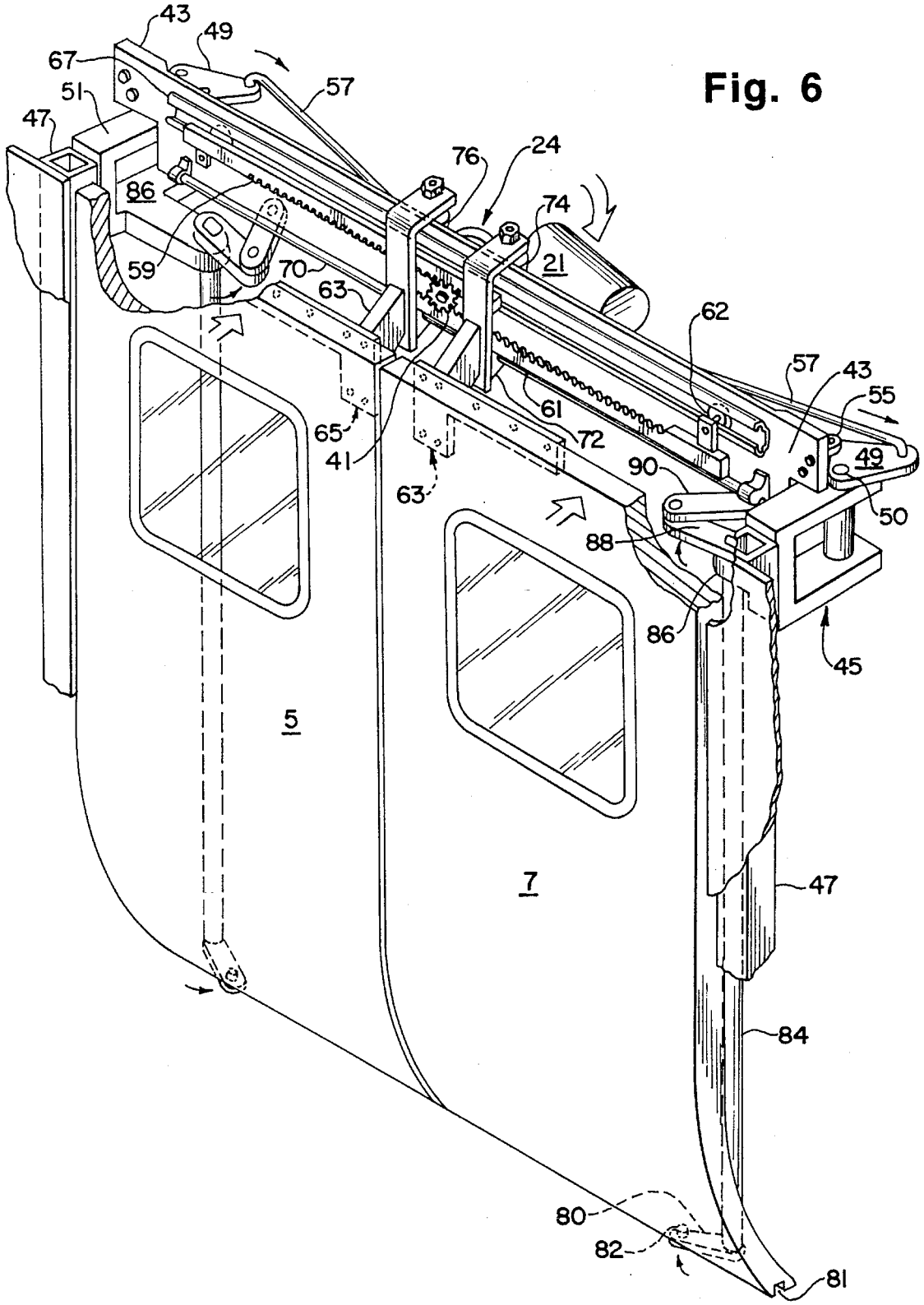
FIG. 6 is an additional perspective view and partial tear-away of the operator and hi-parting doors with the doors in a fully closed and plugged position. Direction arrows adjacent the motor housing and door panels indicate door movement position to a closed and plugged position from the closed and unplugged position of FIG. 5.
Figure 7:
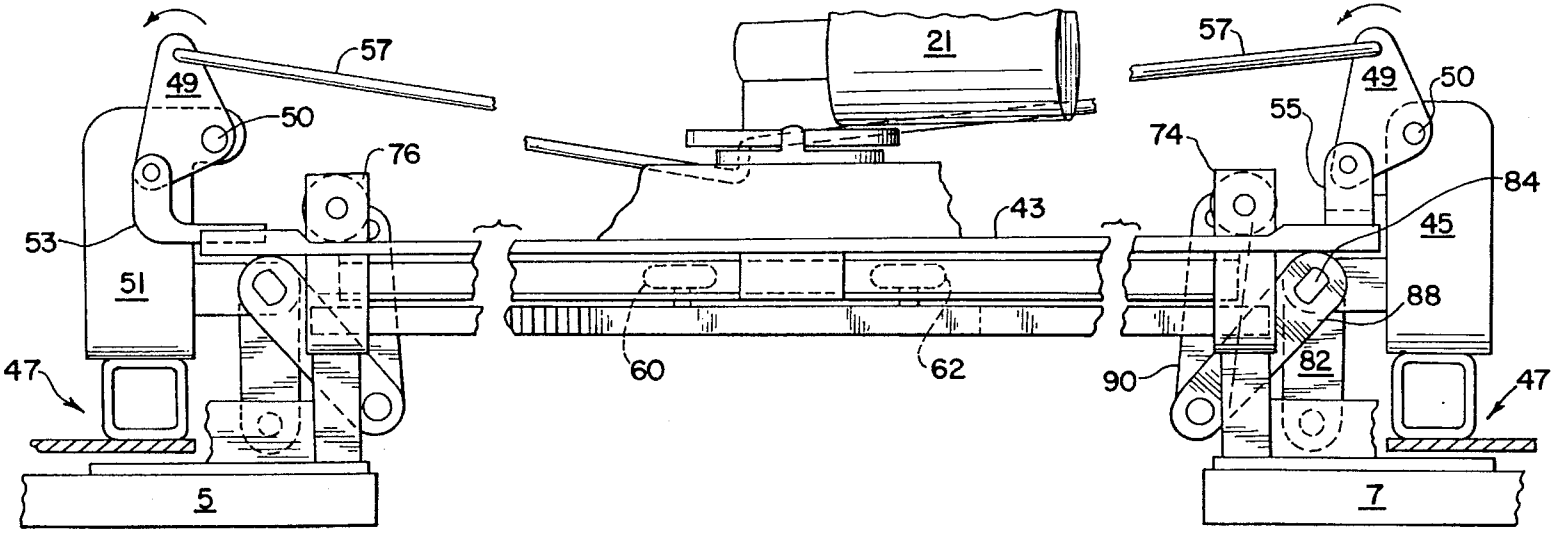
FIG. 7 is a top view of a portion of the operator and door assembly with the doors in an unplugged and fully opened position, particularly showing the position of the lower door support actuating links.

With particular reference to FIGS. 4, 5, and 6, with doors fully open and brackets 63 at either extremes of the base plate 43 and the motor shaft 23 operating in a counterclockwise rotation (as shown), the controllable torque generated between friction plates 25 and 27 is such that no relative motion occurs between them, thereby allowing the pinion 41 to move gear racks 59 and 61 in a direction which moves the doors to a closed but unplugged position (reference FIG. 5).

Figure 9:
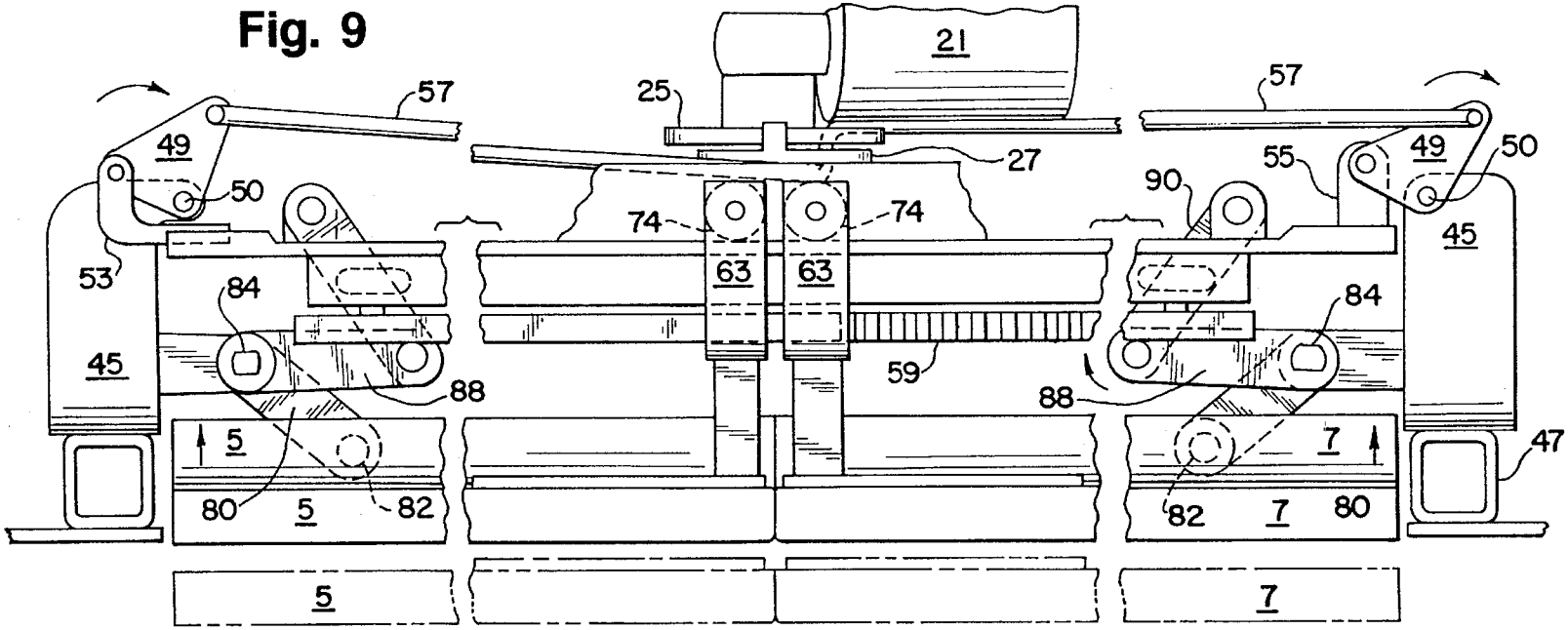
FIG. 9 is a top view of a portion of the operator of the invention as shown in FIG. 7 with the bi-parting door panels in a fully closed and plugged position with door motion and pivot link direction arrows for door plugging, particularly showing position of the lower door support links.

Since at this point, interior or mating edges of doors 5 and 7 abut, thereby essentially increasing the drive torque requirement of drive motor 21, the friction adjustment of plates 25 and 28 is exceeded. The limited excursion during relative motion of disks 25 and 27 allows the drive motor housing and plate 25 to rotate in a clockwise position (reference FIG. 6). With particular reference to FIG. 8, clockwise rotation of plate 25 (not shown) moves gears 31 and 33 so as to move the lever 35 and rods 57 as shown by direction arrows in FIG. 6. With reference to FIG. 9, clockwise rotation of plugging levers 49 in pivotal motion around pivots 50 and links 55 and 53 moves the base plate 43 pivoting around points 50 of brackets 45 and 51 inward of the car side wall opening 2, thereby "plugging" the door into its opening.

As indicated above, (reference FIG. 9) the inward movement of base plate 43 essentially moves link 88 acting through link 90 in a clockwise direction, thereby turning lower door support 82 (reference FIGS. 5 and 6) operating through shaft 84 in a direction so as to simultaneously follow the lower edge of the door 7 into the car side wall opening 2.

In door opening, the above described procedure is reversed. In this operation, drive motor torque exceeds the friction between disks or plates 25 and 27 allowing the motor housing 21 in reaction to the shaft torque to move in a counterclockwise direction (reference FIG. 10), thereby rotating reaction pinion lever 35 in a counterclockwise direction, thereby moving rods 57 and plugging levers 49 counterclockwise (reference FIG. 7). Counterclockwise rotation of levers 49 moves the door base plate 43 out of its opening and disks 25 having reached the end of travel grooves 28, thus limiting motor housing lost motion providing shaft torque to the pinion 41 in a clockwise rotation, thereby moving door support lever 63 in an outward direction thereby opening the door space (reference FIG. 8).

As will be apparent to persons skilled in the art, various modifications, adaptations and variations of the foregoing specific disclosure can be made without departing from the teachings of the present invention:

What is claimed as new and desired to be secured by Letters Patent of the United States is:

1. In an overhead power door operator driving externally sliding door panels to open, close, and plugged positions in an opening in a vehicle side wall, the improvement comprising:

a side wall;

car structural members in said side wall, said members defining an opening having vertical edges;

a pair of door panels;

a base plate having opposite ends, and upper and lower edges for mounting a power operator;

means mounting said base plate in said opening and overhead said panels, said base plate ends adjacent said vertical edges;

a drive motor in said operator having a housing and a rotating output shaft, said shaft journaled in a drive motor housing, for delivering output shaft torque of a first magnitude, said housing providing an equal and opposing torque;

means mounting said drive motor housing on said base plate;

drive means on said base plate coupled to said output shaft, said drive means supporting and moving said panels for reciprocal panel movement away from a position closing said opening to a position away from said opening outside of and along said side wall, and from said outside-side wall position to a position closing said opening on application of said drive motor output shaft torque of said first magnitude, said reciprocal panel movement defining door open and door closed positions, respectively;

means in said drive motor housing mounting means intermediate said motor housing and base plate for releasably coupling said housing and base plate, said coupling providing limited lost motion between said housing and base plate when said drive motor output shaft torque reaches a second magnitude for a door closed position;

means shifting said base plate, said shifting means providing base plate motion perpendicular to said car side wall, for a door closed position, said shifting means moving closed door panels into and out of said opening, thereby establishing plugged and unplugged door positions, respectively;

means intermediate said drive motor housing and shifting means, for transmitting said motor housing lost motion to said base plate, thereby plugging or unplugging said opening;

means selectively energizing and directing said drive motor, providing said drive motor output shaft torque of said first magnitude for moving doors from said door open to door closed and unplugged position and said drive motor output shaft torque of said second magnitude for shifting said doors from closed to plugged position, and from plugged to open positions.

2. The operator of claim 1 wherein said drive means and drive motor further comprise:

a pinion gear on said motor output shaft;

a gear rack pair movably mounted on said base plate, said gear rack pair and pinion gear coacting to provide opposing rack motion for unidirectional motor shaft rotation;

means individually attaching each said gear rack pair to a door panel;

whereby door panels move from open to closed positions and closed to open positions for opposite motor shaft rotation provided by said means selectively energizing.

3. The operator of claim 1 wherein said shifting and transmitting means further comprises:

means intermediate said base plate ends and door opening edges, said means pivoting said base plate ends, said pivoting means shifting said base plate in accordance with said lost motion between said motor housing and base plate; and, link means intermediate said motor housing and pivoting means;

wherein said drive motor housing lost motion exerts motor shaft torque at said drive motor output shaft torque of said second magnitude on said pivoting means to shift said base plate, thereby plugging or unplugging doors for opposite drive motor shaft rotation.

4. In combination, a power door system for unplugging and plugging an opening in a car side wall by shifting a pair of oppositely moving outside sliding door panels out of and into the opening, and thereafter sliding the panels away from and over the opening, respectively, when opening and closing an entrance in a car side wall comprising:

an opening in a car side wall;

a pair of bi-parting door panels, said panels having internal vertical edges, and upper ends, said vertical edges in abutment for a door closed position;

a base plate;

a drive motor having an output shaft journaled in a motor housing for delivering output shaft torque;

means mounting said motor housing on said base plate, said mounting means allowing limited motion between said motor housing and base, and providing motor rotation and shaft torque output in first and second directions during said limited motion for a door closed position;

means mounting said base plate overhead in said opening, said mounting means providing base plate motion, said motion perpendicular to said car side wall and into and out of said opening;

means linking said motor housing and base plate mounting means, said housing motion and linking means moving said base plate into said opening when said drive motor delivers shaft torque in said first direction and out of said opening when said drive motor delivers shaft torque in said second direction;

pinion gear means on said drive motor output shaft;

gear rack means slidably mounted on said base plate, said gear rack means and pinion gear means operatively engaged;

means attaching each said panel and gear rack means, said attaching means and said gear rack means providing reciprocal opening and closing motion of said panels for unidirectional rotation of said pinion gear means on delivery of drive motor shaft torque in said first and second directions;

means selectively engergizing said motor rotation, thereby providing door panel travel from opened to closed and into said opening and door panel travel out of said opening from closed to open.

5. The operator of claim 4 wherein said overhead base plate mounting means further comprises:

opposite ends on said base plate;

opposite interior edges in said side wall opening;

base plate pivots on one of said interior edges and intermediate said base plate and interior edges;

force arms intermediate said pivots and drive motor housing, said force arms rotating said pivots when said motor rotates in said first direction thereby moving said base plate into said opening and out of said opening when said motor rotates in said second direction.

6. The operator of claim 5 wherein said door panel attachment means further comprise:

inner and outer surfaces on said base plate;

longitudinal sliding door support on said base plate outer surface;

a door support bracket attached to each panel adjacent its upper edge;

a bearing on said bracket, said bearing in sliding engagement with said sliding door support;

roller means on said bracket, said roller means traveling on said base plate inner surface;

whereby door panel loads on said bracket are carried by said roller means and sliding support.

7. A door operator powering bi-parting sliding plug doors for sequentially unplugging and opening and closing and plugging an opening in a vehicular side wall comprising:

an opening in a vehicle side wall;

a pair of sliding bi-parting door panels;

a base plate mounted overhead in said opening;

door drive means having an output shaft journaled in a door drive housing for rotary motion therein, said shaft having a pinion gear attached thereto;

means mounting said door drive housing on said base plate;

first and second gear racks slidably mounted on said base plate, said gear racks and pinion gear in operative engagement, said engagement providing opposing rack motion along said base plate for unidirectional gear rotation, said opposing motion defining door open and door closed positions of said panels, respectively, away from and over said opening;

means mounting one of said bi-parting doors on each said rack, said doors moving from open to closed position over said opening;

lost motion means in said mounting means, said lost motion means responding to door drive output shaft rotation when said doors are in a door closed position, and rotating said door drive housing, said door drive housing rotation concentric with said output shaft rotation;

means, on said base plate mounting means, shifting said base plate into and out of said opening, said shifting establishing plugged and unplugged positions of said bi-parting door panels, respectively;

means linking said lost motion and shifting means, said lost motion and linking means, thereby shifting said base plate into and out of said opening on occurrence of said limited lost motion travel;

wherein sequential drive motor shaft rotation and lost motion rotation of said drive motor housing open and close, plug and unplug said bi-parting doors.

8. The operator of claim 7 wherein the base plate shifting means further comprises:

essentially vertical structural members defining said vehicle side wall;

opposite ends on said base plate;

pivotal means intermediate said structural members and base plate ends;

wherein said linking means transfers said lost motion to said pivotal means.

9. The operator of claims 1, 4 and 7 further comprising:

vertical inner and outer edges and a lower end on each said panel;

a groove in said ends;

essentially vertical shaft means in said side wall and adjacent outer door panel edges, said shaft means journaled in said side wall for motion therearound;

upper and lower ends on said shaft;

link means on said lower end, said link means extending into said groove for slidable motion therein;

means attaching said base plate and upper short end, said means rotating said shaft outward and inward of said side wall on shifting of said base plate from door plugged to door unplugged positions;

whereby said groove and link means provides door panel support for door movement in an unplugged position.

* * * * *